US010180049B1

(12) United States Patent
Trafton

(10) Patent No.: US 10,180,049 B1
(45) **Date of Patent: *Jan. 15, 2019**

(54) SYSTEM AND METHOD OF INCREASING RELIABILITY IN HIGH PRESSURE SWITCHES

(71) Applicant: Daniel S. Trafton, Kennedale, TX (US)

(72) Inventor: Daniel S. Trafton, Kennedale, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/184,296

(22) Filed: Jun. 16, 2016

Related U.S. Application Data

(63) Continuation-in-part of application No. 15/055,513, filed on Feb. 26, 2016.

(51) Int. Cl.
*E21B 43/1185* (2006.01)
*H01H 39/00* (2006.01)

(52) U.S. Cl.
CPC ..... *E21B 43/1185* (2013.01); *H01H 39/004* (2013.01)

(58) Field of Classification Search
CPC ..... H01H 39/004; H01H 3/24; H01H 35/24; E21B 43/1185
USPC ..... 200/6 R, 82 R
See application file for complete search history.

(56) References Cited

U.S. PATENT DOCUMENTS

| | | | | |
|---|---|---|---|---|
| 4,520,245 | A * | 5/1985 | Ochsner | H01H 35/38 200/283 |
| 5,155,310 | A * | 10/1992 | Goans | H01H 35/38 200/82 C |
| 7,038,151 | B2 * | 5/2006 | Amaduzzi | H01H 35/2678 200/82 C |
| 8,710,385 | B2 * | 4/2014 | Sickels | F42D 1/045 200/82 R |
| 2010/0051440 | A1 * | 3/2010 | Hurst | F42C 15/32 200/82 R |

* cited by examiner

*Primary Examiner* — Renee Luebke
*Assistant Examiner* — Iman Malakooti
(74) *Attorney, Agent, or Firm* — Damon R. Hickman Law Firm, P.C.

(57) ABSTRACT

A high pressure switch for controlling electrical signals between elements of a gun for perforating hydrocarbon wells. The switch uses mechanical energy from an explosion to change from one electrical path to a second electrical path. The switch has a piston that translates from the shockwave to electrical connect a firing pin to a conductive member while opening an electrical path from the piston to the firing pin.

11 Claims, 21 Drawing Sheets

501

SYSTEM AND METHOD OF INCREASING RELIABILITY IN HIGH PRESSURE SWITCHES

CROSS REFERENCE TO RELATED APPLICATIONS

This application is a continuation-in-part of U.S. patent application Ser. No. 15/055,513 filed 26 Feb. 2016, titled "System and Method of Increasing Reliability in High Pressure Switches;" which is hereby incorporated by reference for all purposes as if fully set forth herein.

BACKGROUND

1. Field of the Invention

The present invention relates generally to electrical switches for oil well equipment, and more specifically to a system and method for improving reliability of high pressure switches located in perforating guns used for the perforation of oil and gas wells.

2. Description of Related Art

Oil and gas wells are perforated to allow hydrocarbons to flow from outside the well to inside the well. Perforations in the well casing are produced by explosive charges arranged in a "gun." Guns comprises several explosive charges wired to several switches. Controlling the explosive charges is a critical task. Insuring the user can control a specific charge in a multitude of charges that allows stage work. High pressure electrical switches are utilized for using the explosive force to move a piston thereby electrically changing an electrical path. Conventional high pressure switches are press fit together, thereby reducing cost. If a high pressure switch fails during use the entire gun assembly must be removed from the well head. Press fit connections between the elements of a conventional high pressure switch reduce reliability of the entire switch and therefore the entire gun.

Conventional high pressure switches are constructed as cheaply and as mass produced as possible. Conventional high pressure switches utilize press fit parts to keep the assembly of conducting and non-conducting parts together. Press fit parts are cheap to produce but create issues for high pressure switches. First, the high forces imparted on the switch overcome the press fit and cause failures in the switch. For example, the press fitted firing pin insulator can be inadvertently ejected from the switch when the press fit between the case of the switch and the firing pin insulator is overcome by the force of the firing pin and the piston. Second, the press fit between the piston assembly and the case can be too great for the explosive force to move the piston. Third, the electrical connection between the firing pin and the rest of the circuit is physically unable to resist the stress of the firing pin in motion because the wiring is soldered adjacent the exposed tip of the firing pin, soldered with a spring surrounding the wire and the tip of the firing pin. The force of the firing pin starting and stopping causes mechanical failure of the solder joint. While there are many systems for pressure switches known in the art, considerable room for improvement remains.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1A:
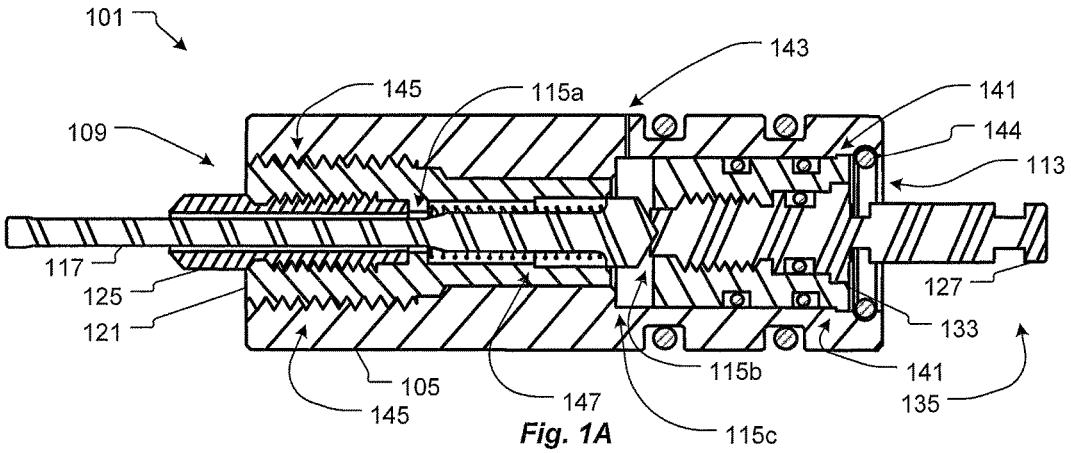
FIG. 1A is a cross section view of a high pressure switch in a first position illustrated according to the present application.

While the assembly of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the apparatus for a system and method of increasing reliability in a high pressure switch are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

A system is herein described that overcomes the limitations of the current high pressure switches for electrically coupling explosive charges. The elements described herein increase the reliability of the system and reduce failures.

Figure 1B:
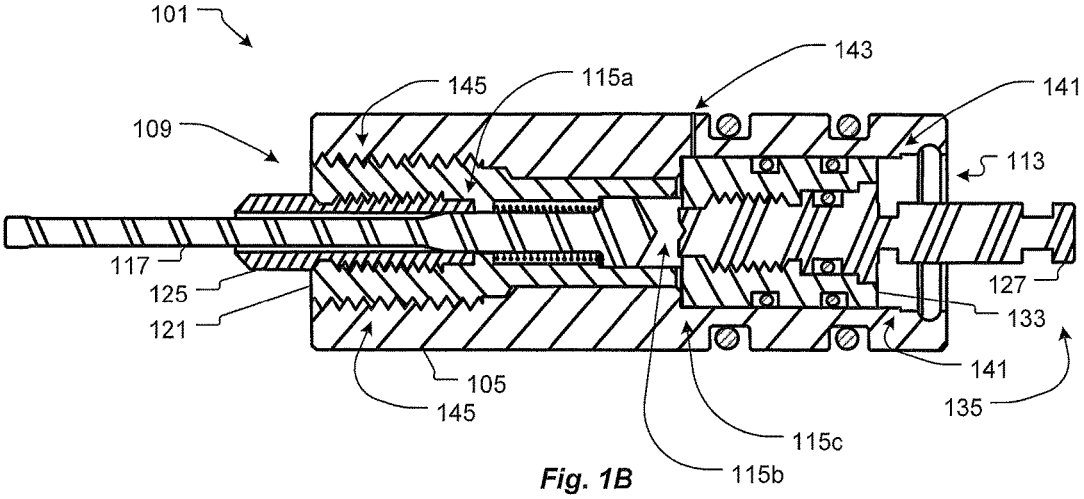
FIG. 1B is a cross section view of a high pressure switch in a second position illustrated according to the present application.

Referring now to FIG. 1A in the drawings, a cross section view of a high pressure switch in a first position illustrated according to the present application. Referring now also to FIG. 1B in the drawings, a cross section view of a high pressure switch in a second position illustrated according to the present application. Switch 101 is comprised of a body 105, a firing pin assembly 109, a piston assembly 113, a first gap 115*a*, a second gap 115*b*, and a third gap 115*c*. Body 105 is tubular shaped with an opening through an entire length of the switch 101. Firing pin assembly 109 is comprised of a firing pin 117, a firing pin insulator 121, and a firing pin conductive member 125. Piston assembly 113 is comprised of a piston conductive member 127 and a piston insulator 133.

Switch 101 is configured to provide a mechanical method of switching a conductive path from an explosive force. Piston assembly 113 translates along a portion of the body as a result of a shockwave from an explosion. Piston assembly 113 is configured to move only in response to high force exerted on a piston end 135 of the switch 101. As piston assembly 113 translates it apply a force upon the firing pin 117, as the piston assembly stops. The firing pin continues to move a distance creating an air gap between the firing pin and the piston. Piston assembly 113 moves from a first position to a second position and the firing pin 117 moves from the first position to the second position. FIG. 1A illustrates the first position. In the first position the switch 101 is non-conductive along the piston to firing pin conductive member 125 path because a first gap 115*a* is open and the firing pin 117 is not in electrical contact with the firing pin conductive member 125. First gap 115*a* exists between the smallest diameter of the firing pin 117 and an internal opening of the firing pin conductive member 125. Second gap 115*b* in the first position does not exist as the gap is between the conical tip of the firing pin 117 and a conical end of the plunger assembly and in the first position the firing pin and the plunger assembly abut each other and are in electrical contact. Third gap 115*c* results from an opening, having a length of three millimeters, between a firing pin end of the piston insulator 131 and a piston end of the firing pin assembly 109. In the second position the switch 101 is conductive along a path from the firing pin conductive member 125 to the firing pin 117 because first gap 115*a* is closed and second gap 115*b* is open. In the second position the piston conductive member 127 is not in contact with the firing pin 117 and therefore no conductive path exists between them.

In order to increase the reliability of the switch 101 over conventional systems, the body 105 features a piston shoulder 141, configured to increase the resistance between the piston assembly 113 and the body, and an opening 143. The piston shoulder 141 is comprised of a decrease in a diameter of the opening through the body. A width of the piston shoulder is preferably between ten thousands of an inch and fifteen thousands of an inch with a ±tolerance of five thousands of an inch. Therefore the diameter of the opening decreases between twenty thousands of an inch and thirty thousands of an inch. The decrease in the opening from the piston end 135 of the switch increases the amount of force required to translate the piston assembly 113. A piston shoulder or break away having a width of twelve thousands of an inch typically requires approximately three hundred pounds of force to distort the piston insulator 133 to allow the piston assembly 113 to translate. Piston shoulder 141 has a length of approximately thirty thousands of an inch with a ±tolerance of ten thousands of an inch.

Opening 143 precludes residual pressure internal to the body. A diameter of opening 143 is preferably twenty thousands of an inch. After use, opening 143 releases any internal pressure between the piston and the firing pin. Opening 143 is connects the gap to the external surface of the body on the firing pin side of the externally mounted o-rings. The location between the o-rings and the firing pin end of the switch precludes fluid from migrating through the opening 143. Other than the piston shoulder 141, the piston assembly is free to move relative to the body as a major portion of the piston assembly has a diameter five thousands of an inch smaller than the piston assembly opening in the body with a ±tolerance of two thousands of an inch. O-ring 144 retains the piston insulator 133 and thereby retains the piston assembly 113 relative to the body 105 without the need for a press fit between the body and the piston assembly.

An additional element to increase the reliability of the switch is a threaded interface 145 between the firing pin assembly 109 and the body 105. The threaded interface 145 provides increased strength between the body 105 and the firing pin assembly 109 to resist the force induced into the firing pin assembly from the piston assembly 113. Preferably a length of the threaded interface is longer than a depth of the firing pin conductive member 125 in the firing pin insulator 121.

Stopping shoulder 147 located in the firing pin insulator 121 prevents the firing pin 117 from moving past a point. Stopping shoulder 147 reduces the failure of the firing pin conductive member 125 to stop the firing pin 117. Conventional switches rely only on friction between the firing pin and the firing pin conductive member to slow and stop the firing pin. Stopping shoulder 147 is configured to stop the firing pin in addition to the friction between the firing pin 117 and the firing pin conductive member 125. Stopping shoulder 147 has a width of ten thousands of an inch, therefore the difference in diameters between regions of the firing pin insulator is approximate twenty thousands of an inch with a ±tolerance of five thousands of an inch.

Figure 2A:
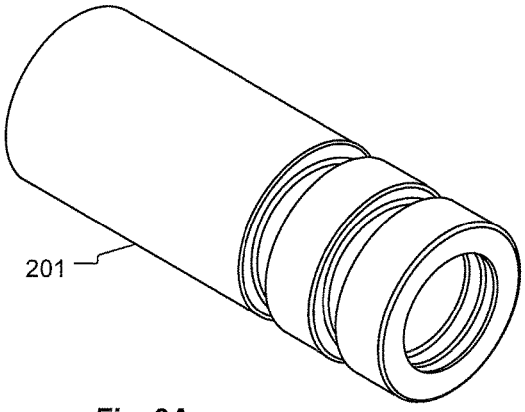
FIG. 2A is a perspective view of a body of a high pressure switch illustrated according to the present application.
Figure 2B:
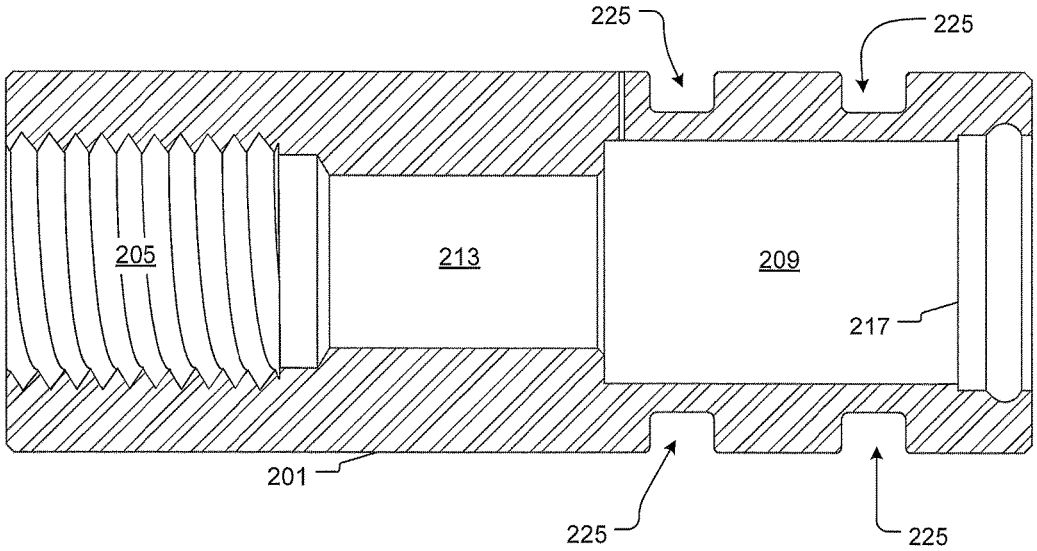
FIG. 2B is a cross section view of a body of a high pressure switch illustrated according to the present application.

Referring now also to FIG. 2A in the drawings, a perspective view of a body of a high pressure switch illustrated according to the present application. Referring now also to FIG. 2B in the drawings, a cross section view of a body of a high pressure switch illustrated according to the present application. Body 201 is rigid and can be metallic or composite. Body 201 is like body 105 and is comprised of a tubular shape with a plurality of openings throughout a length of the body to form a continuous opening from a first end of the body to the second end of the body. A first opening 205 is mostly threaded for retaining a firing pin assembly. A second opening 209 is configured to retain a piston assembly. A third opening 213 connects the first opening 205 to the second opening 209. Body 201 further comprises piston shoulder 217. Piston shoulder 217 increases the amount of force required to move the piston assembly from a first position to a second position. The increased force results from the deformation of the piston assembly moving past the piston shoulder. Body 201 also further comprises annular shaped grooves 225 for retaining o-rings. First opening 205 is threaded to retain the firing pin assembly.

Figure 3A:
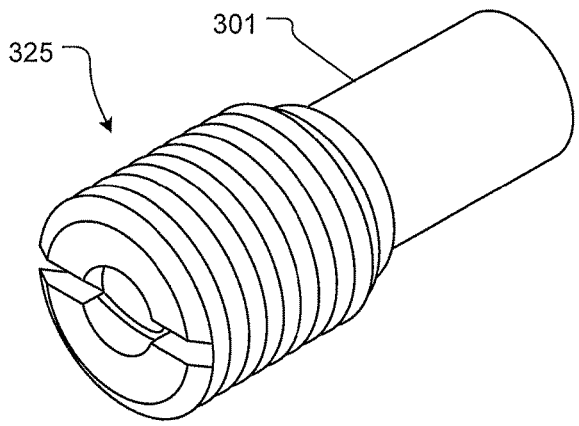
FIG. 3A is a perspective view of an insulator of a high pressure switch illustrated according to the present application.
Figure 3B:
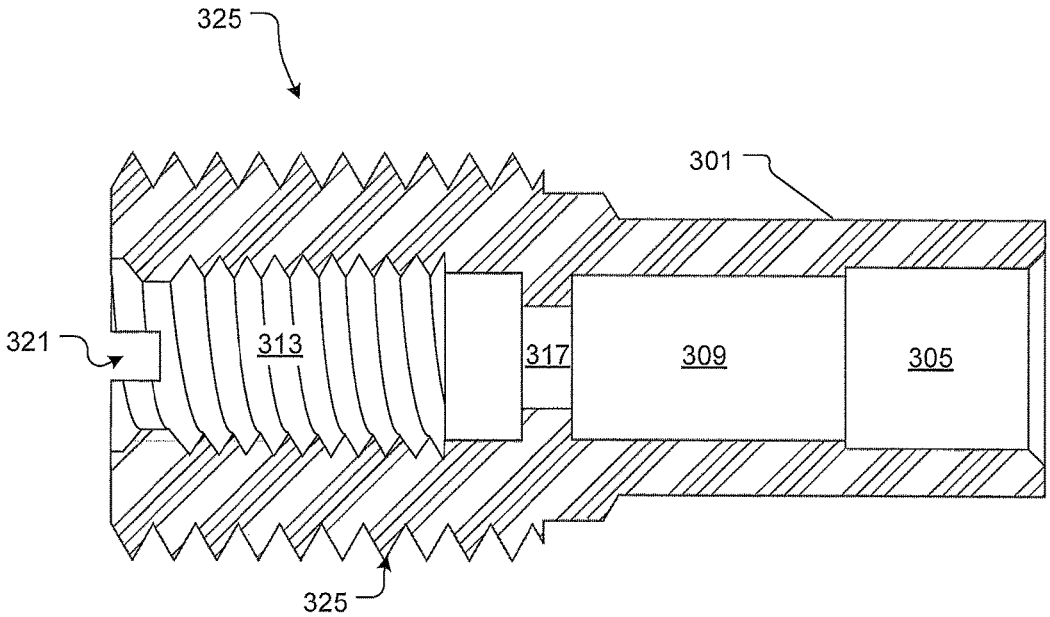
FIG. 3B is a cross section view of an insulator of a high pressure switch illustrated according to the present application.

Referring now also to FIG. 3A in the drawings, a perspective view of a firing pin insulator of a high pressure switch illustrated according to the present application. Referring now also to FIG. 3B in the drawings, a cross section view of a firing pin Insulator of a high pressure switch illustrated according to the present application. Firing pin insulator 301 is fabricated from plastic or any non-conductive material. Preferably the firing pin insulator is fabricated from polyether ether ketone (PEEK). Firing pin insulator 301 is comprised of a plurality of opening from a first end to a second end. First opening 305 is sized to receive a portion of the firing pin. Second opening 309 is sized to provide space for the firing pin and a spring located around the firing pin. Second opening is nineteen thousands smaller in diameter than a head of the firing pin provide a pre-determined stop and a breaking force for the firing pin once the switch has been activated. Third opening 313 is sized to threadingly receive a conductive member. Forth opening 317 connects the second opening 309 to the third opening 313. Firing pin insulator 301 further comprises a notch 321 to facilitate attaching the firing pin insulator to a body via a threaded outer portion 325.

Figure 4A:
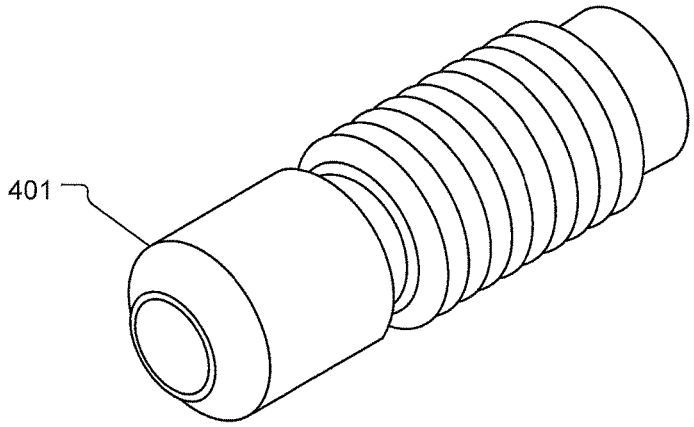
FIG. 4A is a perspective view of a connecting insert of a high pressure switch illustrated according to the present application.
Figure 4B:
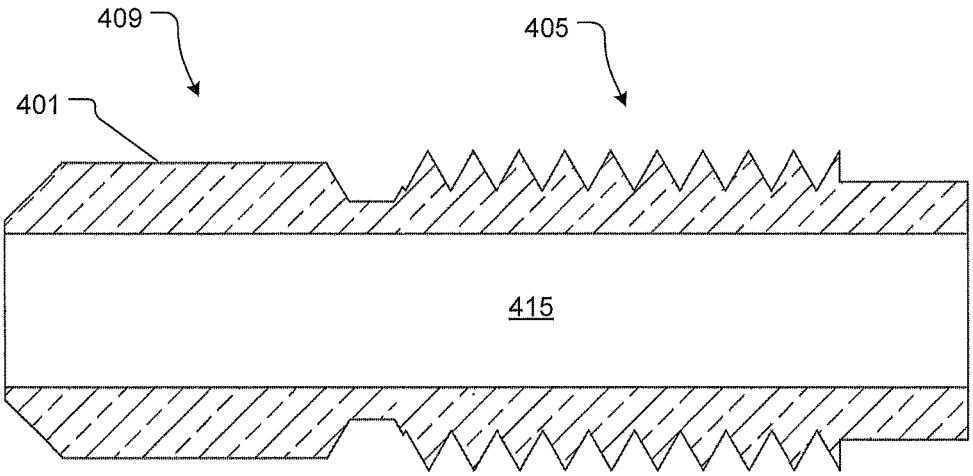
FIG. 4B is a cross section view of a connecting insert of a high pressure switch illustrated according to the present application.

Referring now also to FIG. 4A in the drawings, a perspective view of a conductive member illustrated according to the present application. Referring now also to FIG. 4B in the drawings, a cross section view of a conductive member illustrated according to the present application. Firing pin conductive member 401 is fabricated from preferably brass and is conductive. Firing pin conductive member 401 is tubular and has a threaded portion 405, an exterior portion 409, and an opening 415 that runs the length of the conductive member. Opening 415 preferably has a uniform diameter sized to receive a portion of the firing pin. Threaded portion 405 of the firing pin conductive member 401 is received by the firing pin insulator.

Figure 5A:
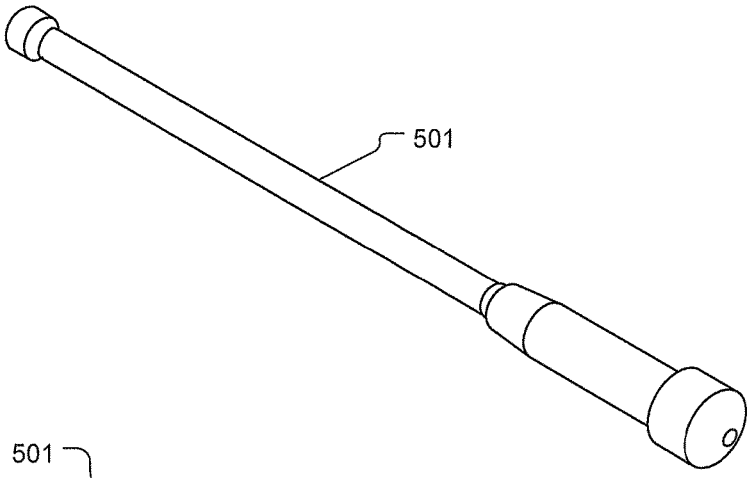
FIG. 5A is a perspective view of a firing pin of a high pressure switch illustrated according to the present application.
Figure 5B:
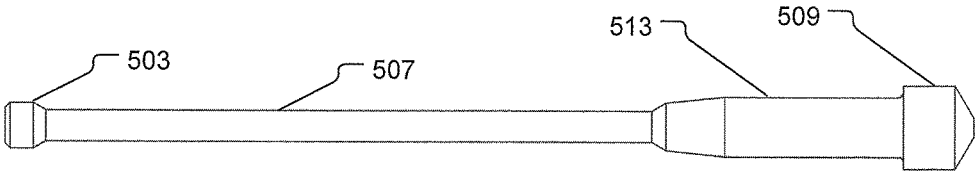
FIG. 5B is a side view of a firing pin of a high pressure switch illustrated according to the present application.

Referring now also to FIG. 5A in the drawings, a perspective view of a firing pin of a high pressure switch illustrated according to the present application. Referring now also to FIG. 5B in the drawings, a side view of a firing pin of a high pressure switch illustrated according to the present application. Firing pin 501 is cylinder shaped member having multiple diameters. Firing pin 501 or plunger pin is preferably fabricated from steel and is conductive. Firing pin 501 is comprised of a tip 503, a narrow portion 507, a stopper 509 or head, and an interconnect portion 513. Interconnect portion is sized to be received by the opening 415 of the conductive member 401. Stopper 509 is sized larger than the opening 309 to prevent the firing pin 501 from leaving the switch. Typically narrow portion 507 is covered by a layer of insulative materials, such as plastic. The plastic prevents conduction between the narrow portion 507 and the opening 415 even though there is an air gap between the narrow portion 507 and the opening 415 before the switch has been activated. Tip 503 is the portion of the pin where wiring is typically soldered to and is preferably tinned plated to ease soldering.

Figure 5C:
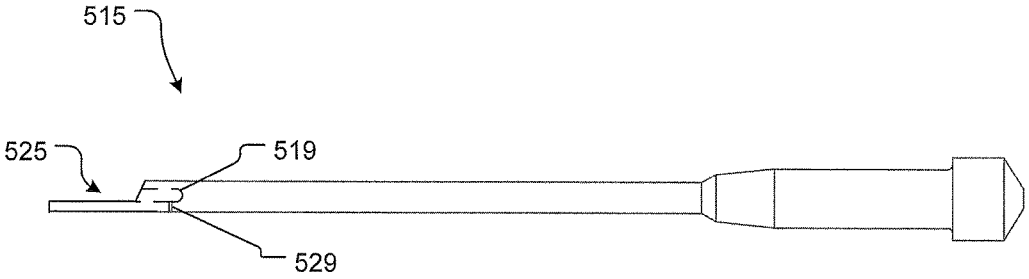
FIG. 5C is a side view of an alternative firing pin of a high pressure switch illustrated according to the present application

Referring now also to FIG. 5C in the drawings, a side view of an alternative firing pin of a high pressure switch illustrated according to the present application. Firing pin 515 is an alternative embodiment compared to firing pin 501. Firing pin 515 further comprises a recess 519 located in a tip of the firing pin 515, recess 519 acts as a solder cup. Firing pin 515 also comprises a cut 525 located at the tip of the firing pin 515 and an opening 529. Recess 519 and cut 525 allow a user to increase the strength of the soldered interface between the pin and the wiring by aligning an axis of the firing pin with an axis of the wiring. Opening 529 is configured for venting between the recess 519 and the atmosphere thereby preventing pockets of gases from accumulating between the recess 519 and the wiring. Opening 529 is located between a portion of the recess and a surface of the firing pin.

Figure 6A:
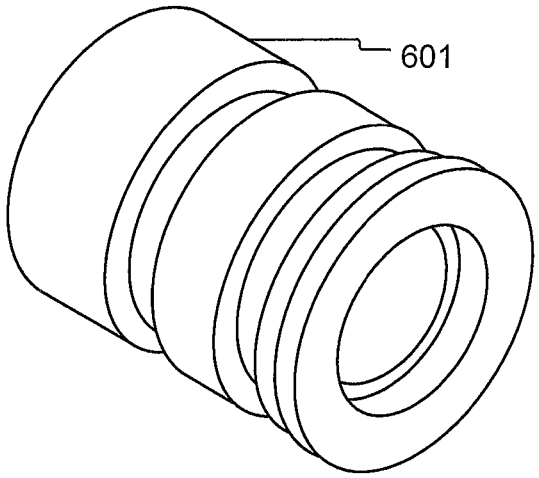
FIG. 6A is a perspective view of a piston insulator of a high pressure switch illustrated according to the present application.
Figure 6B:
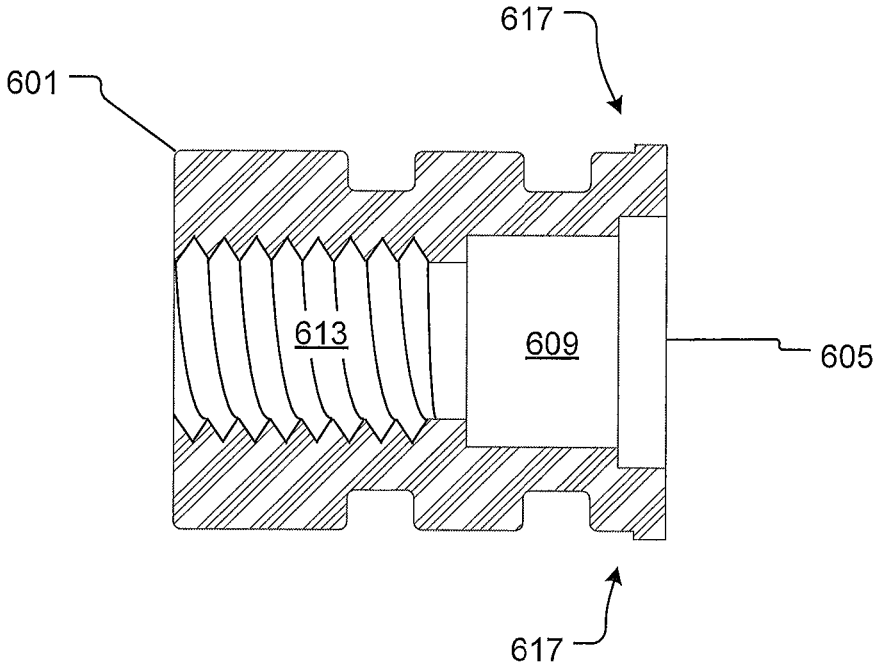
FIG. 6B is a cross section view of a piston insulator of a high pressure switch illustrated according to the present application.

Referring now also to FIG. 6A in the drawings, a perspective view of a piston insulator of a high pressure switch illustrated according to the present application. Referring now also to FIG. 6B in the drawings, a cross section view of a piston insulator of a high pressure switch illustrated according to the present application. Piston insulator 601 is fabricated from plastic and is non-conductive. Preferably the piston insulator is fabricated from polyether ether ketone (PEEK). Piston insulator 601 is comprised of a plurality of openings from a first end to a second end. First opening 605 is sized to receive a widest portion of the piston conductive member. Second opening 609 is sized to provide space for the piston conductive member and an o-ring located around the piston conductive member. Third opening 613 is sized to threadingly receive the piston conductive member. An outer surface of the piston insulator is defined by a first diameter and a smaller second diameter. The difference between those two diameters results in a break away shoulder 617. Break away shoulder 617 is typically ten to fifteen thousands of an inch in width. A length of the break away shoulder 617 is preferably thirty thousands of an inch with a ±tolerance of three thousands of an inch. Break away shoulder 617 is configured to deform in response to approximately three hundred pounds of force applied to the piston. The shoulder 617 is located and configured to provide a stroke length of three millimeters to the piston assembly. This additional force dampens the piston and reduces the probability that the firing pin is ejected from the switch during use. The smaller second diameter comprises a series of grooves cut into the surface, preferable two, configured to retain an o-ring.

Figure 7A:
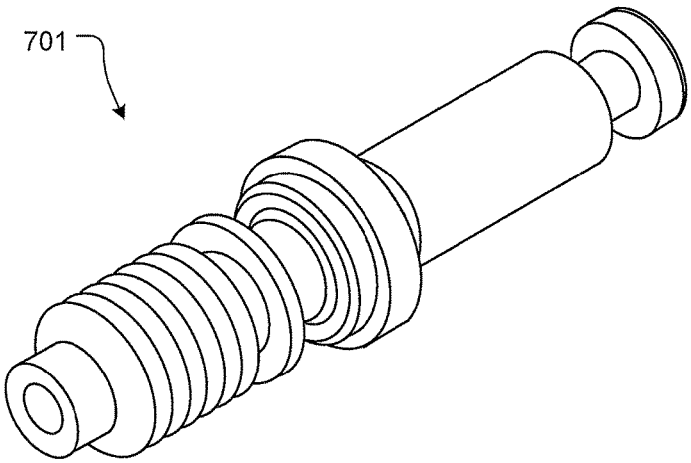
FIG. 7A is a perspective view of a piston contact of a high pressure switch illustrated according to the present application.
Figure 7B:
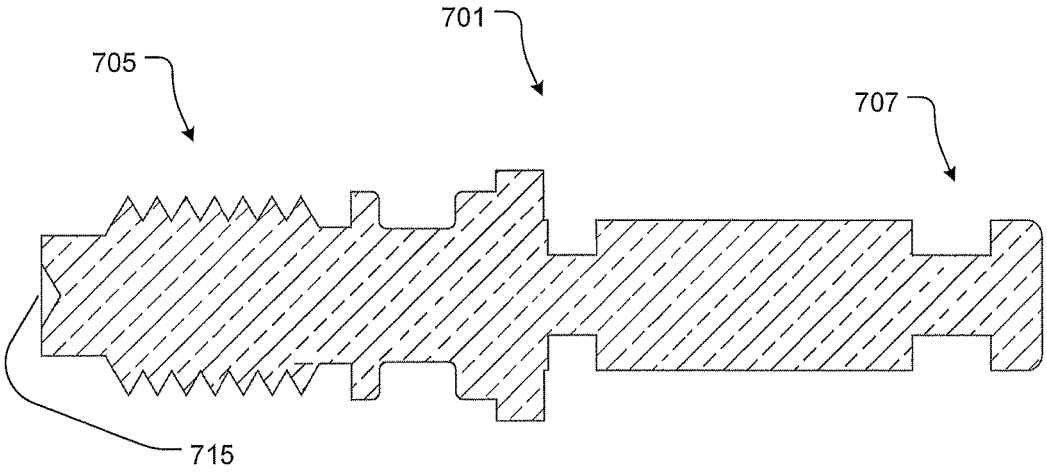
FIG. 7B is a cross section view of a piston contact of a high pressure switch illustrated according to the present application.

Referring now also to FIG. 7A in the drawings, a perspective view of a piston of a high pressure switch illustrated according to the present application. Referring now also to FIG. 7B in the drawings, a cross section view of a piston conductive member of a high pressure switch illustrated according to the present application. Piston 701 is conductive and is preferably fabricated from brass. Piston 701 is comprised of a threaded end 705 and a notched end 707. Threaded end 705 is retained by the threaded piston insulator. Notched end 707 comprises a notch cut into the protruding end of the piston configured for securing a wire to. An end 715 opposite to the notched end 707 is recessed to receive a pointed tip of the firing pin. The conical recess of the end 715 keeps the piston 701 aligned with the firing pin.

Maintaining an electrical connection to the firing pin is difficult due to the high speed nature of using explosives to move the piston and therefore the firing pin. Wiring soldered to the end of the firing pin 505 as shown in FIG. 5C can fall where the wire meets the solder. In order to reduce the risk of breaking the wire, a new and improved electrical connection between the firing pin and the rest of the circuit has been developed. The new electrical connection is comprised of an additional insulator threaded into the firing pin insulator and a sliding electrical connection threaded in the new additional Insulator. The electrical connection is a tubular member cut and biased at an end to maintain an electrical contact with the sliding firing pin. Therefore a slidingly electrical connection is made to the firing pin instead of soldering a wire to the firing pin.

Figure 8A:
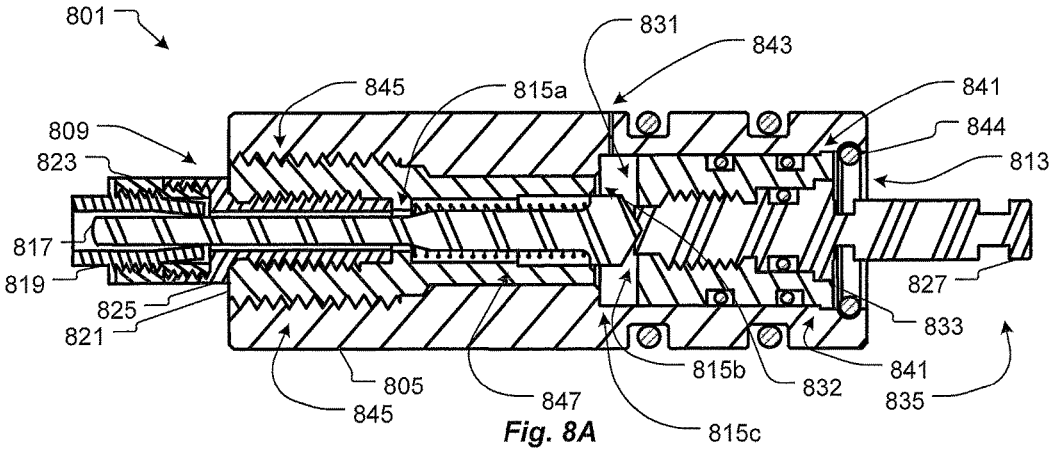
FIG. 8A is a cross section view of a high pressure switch with a sliding electrical connection in a first position illustrated according to the present application.
Figure 8B:
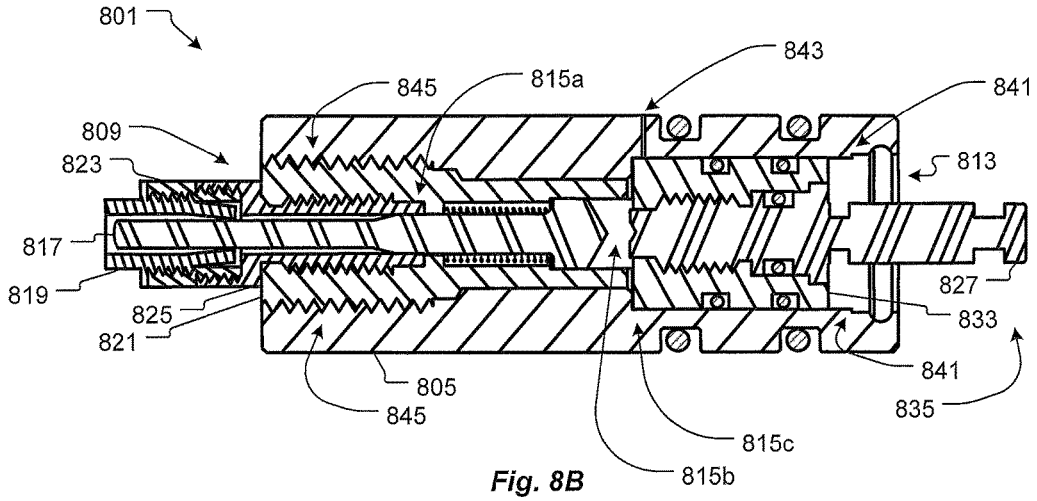
FIG. 8B is a cross section view of a high pressure switch with a sliding electrical connection in a second position illustrated according to the present application.

Referring now also to FIG. 8A in the drawings, a cross section view of a high pressure switch with a sliding electrical connection in a first position illustrated according to the present application. Referring now also to FIG. 8B in the drawings, a cross section view of a high pressure switch with a sliding electrical connection in a second position illustrated according to the present application. Switch 801 is comprised of a body 805, a firing pin assembly 809, a piston assembly 813, a first gap 815*a*, a second gap 815*b*, and a third gap 815*c*. Body 805 is tubular shaped with an opening through an entire length of the switch 801. Firing pin assembly 809 is comprised of a firing pin 817, a biased conductive member 819, a first firing pin insulator 821, a second firing pin insulator 823, and a firing pin conductive member 825. Piston assembly 813 is comprised of a piston conductive member 827 and a piston insulator 833.

Switch 801 is configured to provide a mechanical method of switching a conductive path from an explosive force. Piston assembly 813 translates along a portion of the body as a result of a shockwave from an explosion. Piston assembly 813 is configured to move only in response to high force exerted on a piston end 835 of the switch 801. As piston assembly 813 translates it apply a force upon the firing pin 817, as the piston assembly stops the firing pin continues to move a distance creating an air gap between the firing pin and the piston. Piston assembly 813 moves from a first position to a second position and the firing pin 817 moves from the first position to the second position. FIG. 8A illustrates the first position. In the first position the switch 801 is non-conductive along the piston to firing pin conductive member 825 path because a first gap 815*a* is open and the firing pin 817 is not in electrical contact with the firing pin conductive member 825. First gap 815*a* exists between the smallest diameter of the firing pin 817 and an internal opening of the firing pin conductive member 825. Second gap 815*b* in the first position does not exist as the gap is between the conical tip of the firing pin 817 and a conical end of the plunger assembly and in the first position the firing pin and the plunger assembly abut each other and are in electrical contact. Third gap 815*c* results from an opening, having a length of three millimeters, between a firing pin end of the piston insulator 831 and a piston end of the firing pin assembly 832. In the second position the switch 801 is conductive along a path from the firing pin conductive member 825 to the firing pin 817 because first gap 815*a* is closed and second gap 815*b* is open. In the second position the piston conductive member 827 is not in contact with the firing pin 817 and therefore no conductive path exists between them.

In order to increase the reliability of the switch 801 over conventional systems, the body 805 features a piston shoulder 841, configured to increase the resistance between the piston assembly 813 and the body, and an opening 843. The piston shoulder 841 is comprised of a decrease in a diameter of the opening through the body. A width of the piston shoulder is preferably between ten thousands of an inch and fifteen thousands of an inch with a ±tolerance of five thousands of an inch. Therefore the diameter of the opening decreases between twenty thousands of an inch and thirty thousands of an inch. The decrease in the opening from the piston end 835 of the switch increases the amount of force required to translate the piston assembly 813. A piston shoulder or break away having a width of twelve thousands of an inch typically requires approximately three hundred pounds of force to distort the piston insulator 833 to allow the piston assembly 813 to translate. Piston shoulder 841 has a length of approximately thirty thousands of an inch with a ±tolerance of ten thousands of an inch.

Opening 843 precludes residual pressure internal to the body. A diameter of opening 843 is preferably twenty thousands of an inch. After use, opening 843 releases any internal pressure between the piston and the firing pin. Opening 843 connects the gap to the external surface of the body on the firing pin side of the externally mounted o-rings. The location between the o-rings and the firing pin end of the switch precludes fluid from migrating through the opening 843. Other than the piston shoulder 841, the piston assembly is free to move relative to the body as a major portion of the piston assembly has a diameter five thousands of an inch smaller than the piston assembly opening in the body with a ±tolerance of two thousands of an inch. O-ring 844 retains the piston insulator 833 and thereby retains the piston assembly 813 relative to the body 805 without the need for a press fit between the body and the piston assembly.

An additional element to increase the reliability of the switch is a threaded interface 845 between the firing pin assembly 809 and the body 805. The threaded interface 845 provides increased strength between the body 805 and the firing pin assembly 809 to resist the force induced into the firing pin assembly from the piston assembly 813 and firing pin 817. Preferably a length of the threaded interface is longer than a depth of the firing pin conductive member 825 in the first firing pin insulator 821.

Stopping shoulder 847 located in the first firing pin insulator 821 prevents the firing pin 817 from moving past a point. Stopping shoulder 847 reduces the failure of the firing pin conductive member 825 to stop the firing pin 817. Conventional switches rely only on friction between the firing pin and the firing pin conductive member to slow and stop the firing pin. Stopping shoulder 847 is configured to stop the firing pin in addition to the friction between the firing pin 817 and the firing pin conductive member 825. Stopping shoulder 847 has a width of ten thousands of an inch, therefore the difference in diameters between regions of the firing pin insulator is approximate twenty thousands of an inch with a ±tolerance of five thousands of an inch.

Second firing pin insulator 823 is comprised of a material, such as plastic, that prevents electrical connections between the firing pin conductor 825 and the biased conductive member 819. Biased conductive member 819 is comprised of a threaded metallic tube having a plurality of springy finger like members in contact with the firing pin. The biased conductive member 819 has an opening throughout the center of the member having an average inner diameter greater than the diameter of the firing pin. However, the finger like members are compressed or preloaded to have an inner diameter smaller than the diameter of the firing pin. Therefore the finger like members remain in contact with the firing pin as the firing pin translates. The finger like members create a first sliding electrical connection between the biased conductive member and the firing pin. Once the switch is activated the firing pin is in electrical contact with the firing pin conductive member as it slides past to form a second electrical connection. Therefore the biased conductive member remains stationary while the firing pin translates. This reduces the likelihood that the electrical connection between the switch and the rest of the string will fail as a result of the firing pin's force breaking the soldered connection to the firing pin.

Alternative embodiments are contemplated by the application in regards to maintaining an electrical connection between the firing pin 817 and the biased conductive member 819. For example, the biased conductive member is a spring loaded brush in direct contact with the firing pin. Additionally, the biased conductive member is a coil of wire around the firing pin.

Switch 801 provides an electrical connection between two electrical circuits. Wiring is typically hand wound around an exposed end of the piston conductive member 827, the firing pin conductive member 825, and to the biased conductive member 819. Before the switch is activated there is an electrical circuit between the piston conductive member 827 and to the biased conductive member 819 and the rest of the string. Once the switch has been explosively activated, the electrical circuit between the piston conductive member 827 and to the biased conductive member 819 is opened. The actuation of the switch does close a circuit between the biased conductive member 819 and the firing pin conductive member 825.

Figure 9A:
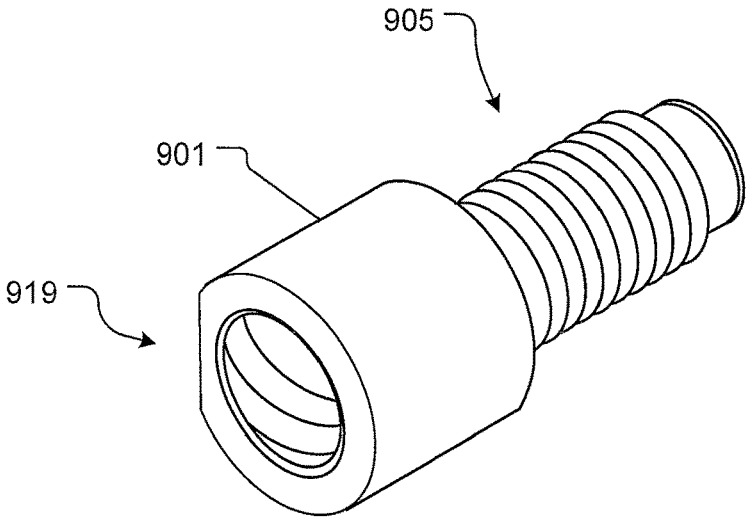
FIG. 9A is a perspective view of an alternative connecting insert of a high pressure switch illustrated according to the present application.
Figure 9B:
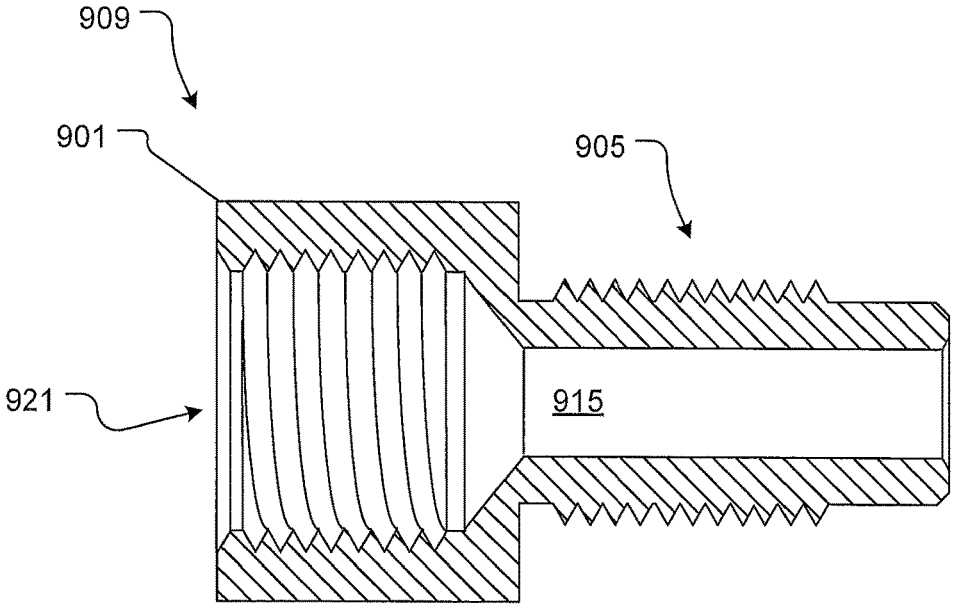
FIG. 9B is a cross section view of an alternative connecting insert of a high pressure switch illustrated according to the present application.

Referring now also to FIG. 9A in the drawings, a perspective view of a conductive member illustrated according to the present application. Referring now also to FIG. 9B in the drawings, a cross section view of a conductive member illustrated according to the present application. Firing pin conductive member 901 is fabricated from preferably brass and is conductive. Firing pin conductive member 901 is tubular and has a first threaded portion 905, an exterior portion 909, and an opening 915 that runs the length of the conductive member. Opening 915 preferably has a uniform diameter and sized to receive a portion of the firing pin. First threaded portion 905 of the firing pin conductive member 901 is received by the firing pin insulator. Firing pin conductive member 901 further comprises a flatten region 919 and a second threaded portion 921 inside the exterior portion 909 and is configured to retain an insulator exterior to the body of the switch. Flatten region 919 is configured for the soldering of an electrical connection between the firing pin conductive member and the rest of the firing string.

Figure 10A:
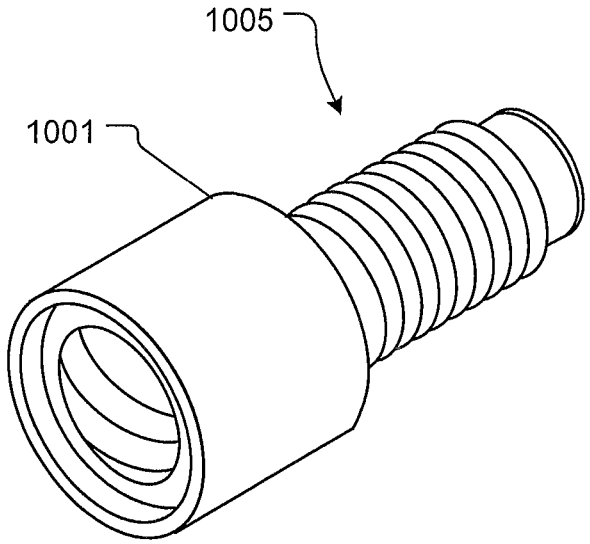
FIG. 10A is a perspective view of an insulator of a high pressure switch illustrated according to the present application.
Figure 10B:
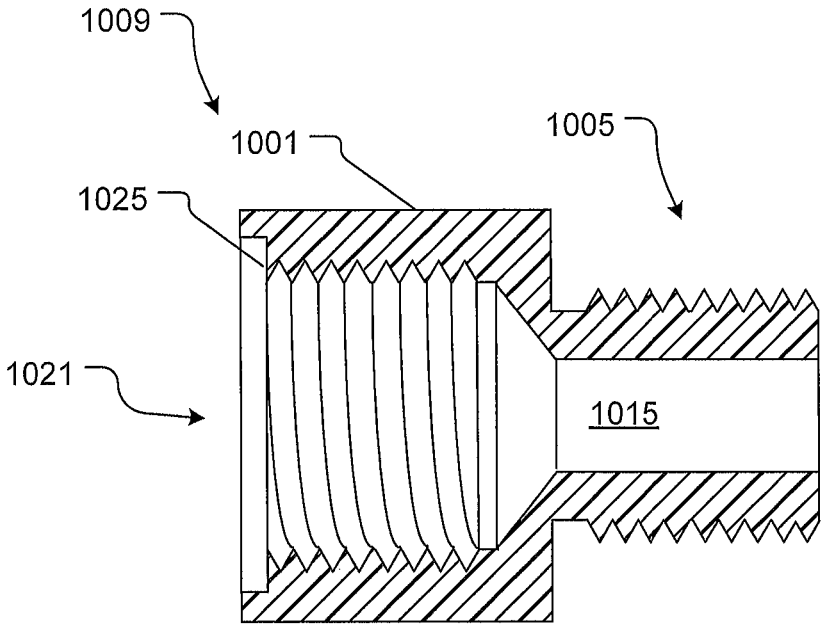
FIG. 10B is a cross section view of an insulator of a high pressure switch illustrated according to the present application.

Referring now also to FIG. 10A in the drawings, a perspective view of a non-conductive member illustrated according to the present application. Referring now also to FIG. 10B in the drawings, a cross section view of a non-conductive member illustrated according to the present application. Second firing pin insulator 1001 is fabricated from preferably plastic and is non-conductive. Second firing pin insulator 1001 is tubular and has a first threaded portion 1005, an exterior portion 1009, and an opening 1015 that runs the length of the non-conductive member. Opening 1015 preferably has a uniform diameter and sized larger than thinnest portion of the firing pin. First threaded portion 1005 of the second firing pin insulator 1001 is received by the firing pin conductive member. Second firing pin insulator 1001 further comprises a second threaded portion 1021 inside the exterior portion 1009, an opening 1025 configured to retain an edge of the biased conductive member, and is configured to retain a biased conductive member exterior to the body of the switch.

Figure 11A:
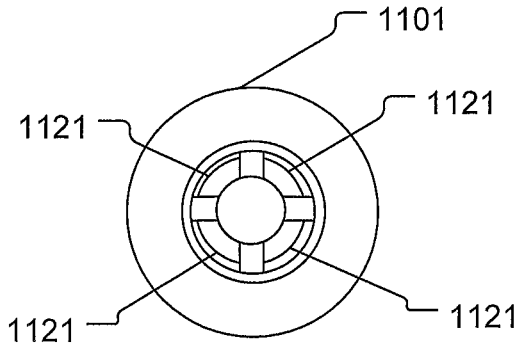
FIG. 11A is a end view of a biased conductive member of a high pressure switch illustrated according to the present application.
Figure 11B:
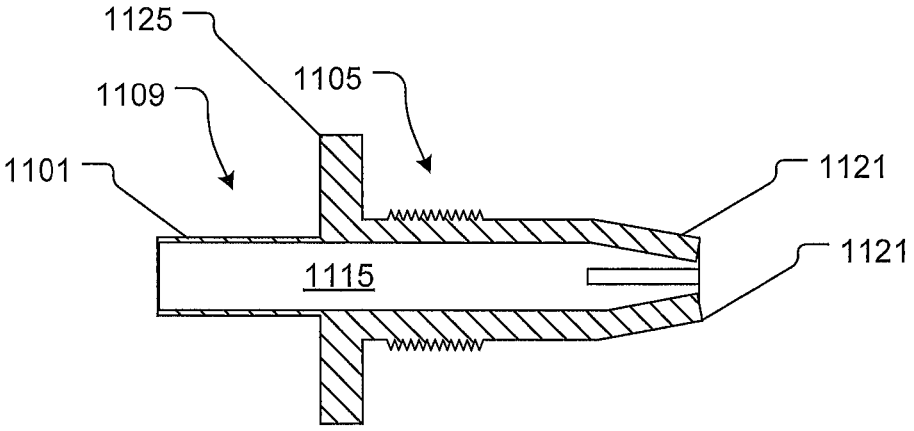
FIG. 11B is a cross section view of a biased conductive member of a high pressure switch illustrated according to the present application.

Referring now also to FIG. 11A in the drawings, an end view of a biased conductive member illustrated according to the present application. Referring now also to FIG. 11B in the drawings, a cross section view of a biased conductive member illustrated according to the present application. Biased conductive member 1101 is fabricated from preferably brass, is conductive and one-piece. Biased conductive member 1101 is tubular and has a threaded portion 1105, an exterior portion 1109, and an opening 1115 that runs the length of the conductive member. Opening 1115 preferably has a uniform diameter and sized to receive a portion of the firing pin near a plurality of spring like finger member 1121. The finger members are made by cutting slots into the tubular member and crimping the finger members until the inner diameter of the biased conductive member is smaller than a narrowest portion of the firing pin. Threaded portion 1105 of the biased conductive member 1101 is received by the second firing pin insulator. Exterior portion 1109 is configured for the soldering of an electrical connection between the biased conductive member and the rest of the string. Ring 1125 is configured to be retained by the opening 1025 of the second firing pin insulator 1001. It should be apparent that an electrical connection can be created by crimping wiring to the exterior portion 1109 of the biased conductive member 1101 instead of, or in addition to soldering.

Figure 12A:
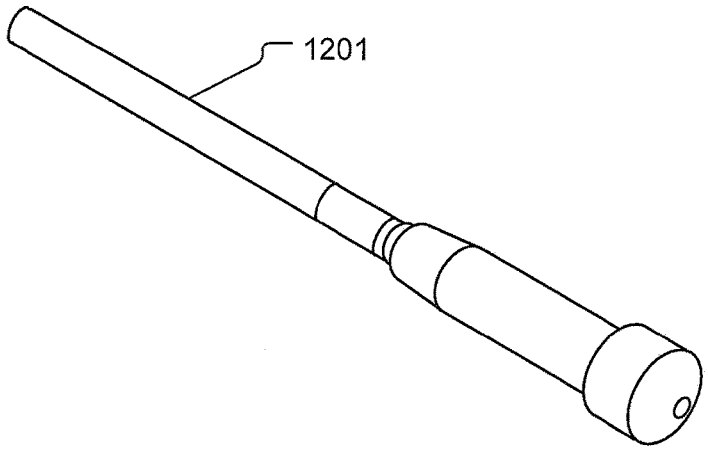
FIG. 12A is a perspective view of an alternative firing pin of a high pressure switch illustrated according to the present application.
Figure 12B:
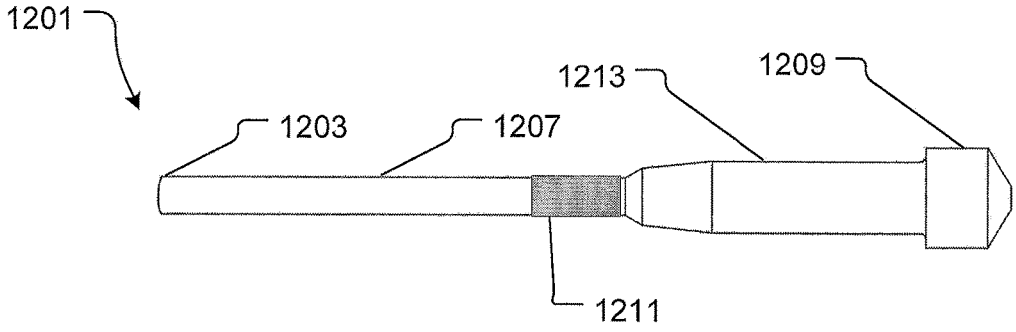
FIG. 12B is a side view of a firing pin of an alternative high pressure switch illustrated according to the present application.

Referring now also to FIG. 12A in the drawings, a perspective view of a firing pin of a high pressure switch illustrated according to the present application. Referring now also to FIG. 12B in the drawings, a side view of a firing pin of a high pressure switch illustrated according to the present application. Firing pin 1201 is cylinder shaped member having multiple diameters. Firing pin 1201 or plunger pin is preferably fabricated from steel and is conductive. Firing pin 1201 is comprised of a tip 1203, a narrow portion 1207, a stopper 1209 or head, a sleeve 1211, and an interconnect portion 1213. Interconnect portion is sized to be received by the opening 415 of the conductive member 401. Stopper 1209 is sized larger than the opening 309 to prevent the firing pin 1201 from leaving the switch. Typically narrow portion 1207 is partially covered by a layer of insulative materials, such as plastic sleeve 1211. The plastic prevents conduction between the narrow portion 1207 and the opening 415 even though there is an air gap between the narrow portion 1207 and the opening 415 before the switch has been activated.

Figure 13A:
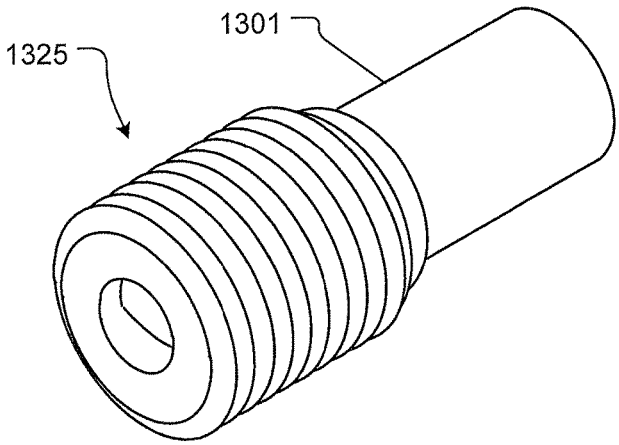
FIG. 13A is a perspective view of an insulator of a high pressure switch illustrated according to the present application.
Figure 13B:
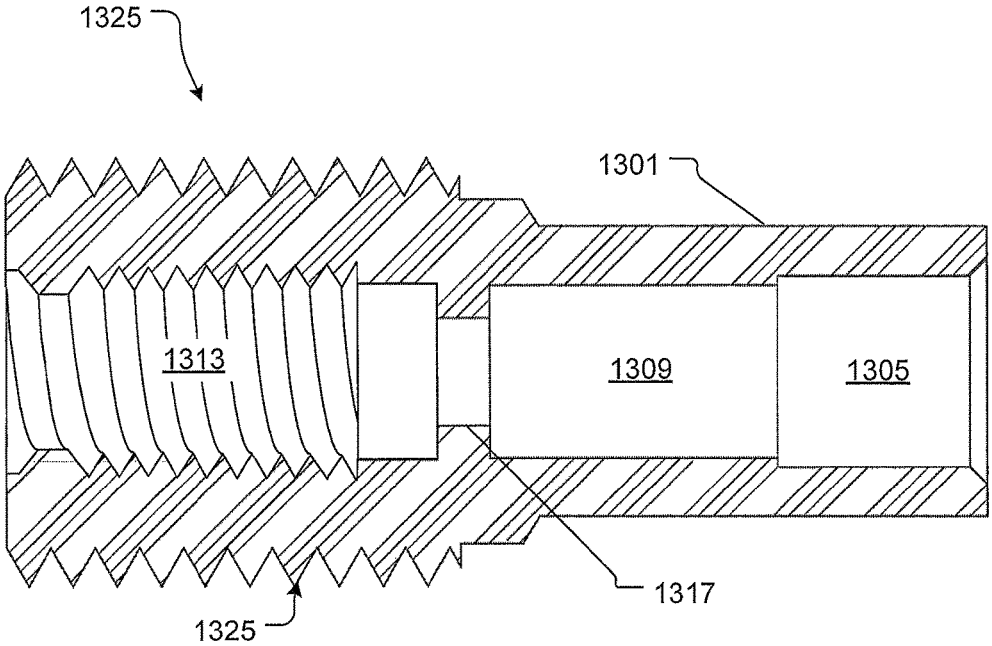
FIG. 13B is a cross section view of an insulator of a high pressure switch illustrated according to the present application.

Referring now also to FIG. 13A in the drawings, a perspective view of a firing pin insulator of a high pressure switch illustrated according to the present application. Referring now also to FIG. 13B in the drawings, a cross section view of a firing pin insulator of a high pressure switch illustrated according to the present application. Firing pin insulator 1301 is fabricated from plastic and is non-conductive. Preferably the firing pin insulator is fabricated from polyether ether ketone (PEEK). Firing pin insulator 1301 is comprised of a plurality of opening from a first end to a second end. First opening 1305 is sized to receive a portion of the firing pin. Second opening 1309 is sized to provide space for the firing pin and a spring located around the firing pin. Second opening is nineteen thousands smaller in diameter than a head of the firing pin provide a predetermined stop and a breaking force for the firing pin once the switch has been activated. Third opening 1313 is sized to threadingly receive a conductive member. Forth opening 1317 connects the second opening 1309 to the third opening 1313. Firing pin insulator 1301 does not comprise a notch like notch 321 as conductive cleaning material occasionally is retained in the notch and can short the switch out by creating a path between the body of the switch and the firing pin.

Figure 14A:
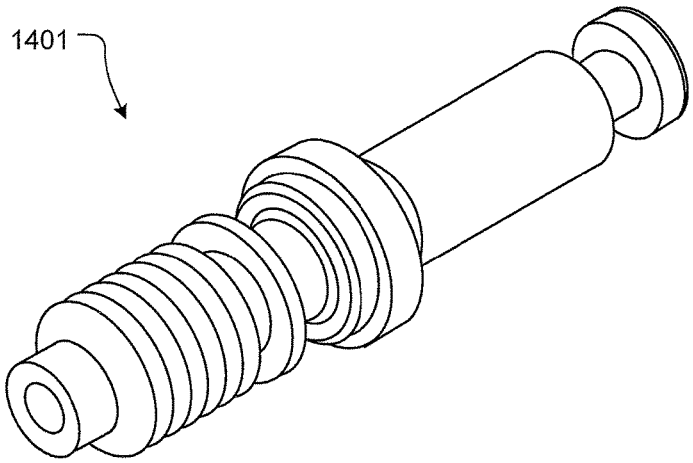
FIG. 14A is a perspective view of a piston contact of a high pressure switch illustrated according to the present application.
Figure 14B:
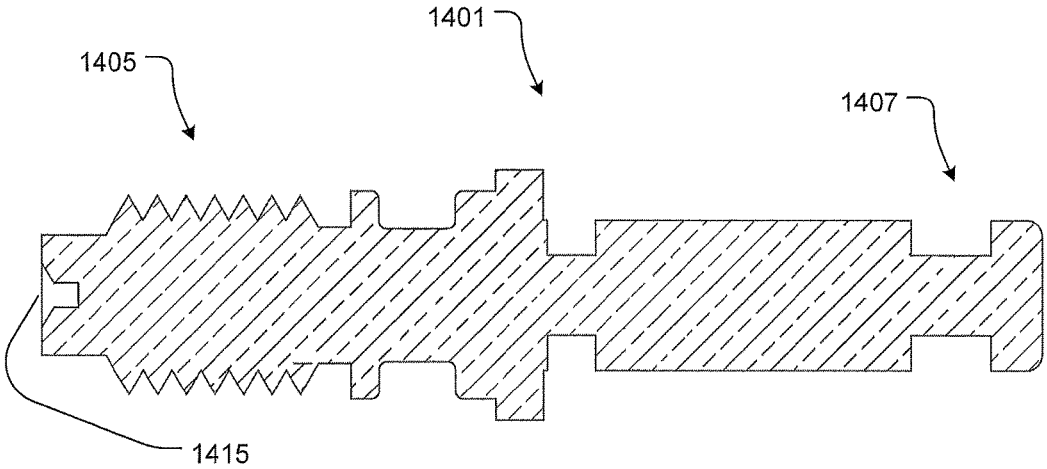
FIG. 14B is a cross section view of a piston contact of a high pressure switch illustrated according to the present application.

Referring now also to FIG. 14A in the drawings, a perspective view of a piston conductive member of a high pressure switch illustrated according to the present application. Referring now also to FIG. 14B in the drawings, a cross section view of a piston of a high pressure switch illustrated according to the present application. Piston 1401 is conductive and is preferably fabricated from brass. Piston 1401 is comprised of a threaded end 1405 and a notched end 1407. Threaded end 1405 is retained by the threaded piston insulator. Notched end 1407 comprises a notch cut into the protruding end of the piston configured for securing a wire to. An end 1415 opposite to the notched end 1407 is recessed to receive a pointed tip of the firing pin. The conical recess of the end 1415 keeps the piston 1401 aligned with the firing pin. Furthermore at a tip of the conical recess is cylindrical recess to accommodate machining errors in the head of the firing pin.

One of the limitations of the switch 801 is the second firing pin insulator 823 retains the biased conductive member 819. In some uses where the explosive charge used is of such great force to perforate the well casing can cause the plastic second firing pin insulator 823 to fail. In order to increase the strength of the switch from large explosive charges an improved system is required to retain the biased conductive member that still allows for a sliding electrical connection and increases the strength of the parts. In this embodiment the biased conductive member is sandwiched between two separate insulators while retained between the metallic firing pin conductive member and a metallic end cap. In this embodiment the force requires to eject the biased conductive member is greater because of the metallic end cap securing the assembly to the switch.

Figure 15A:
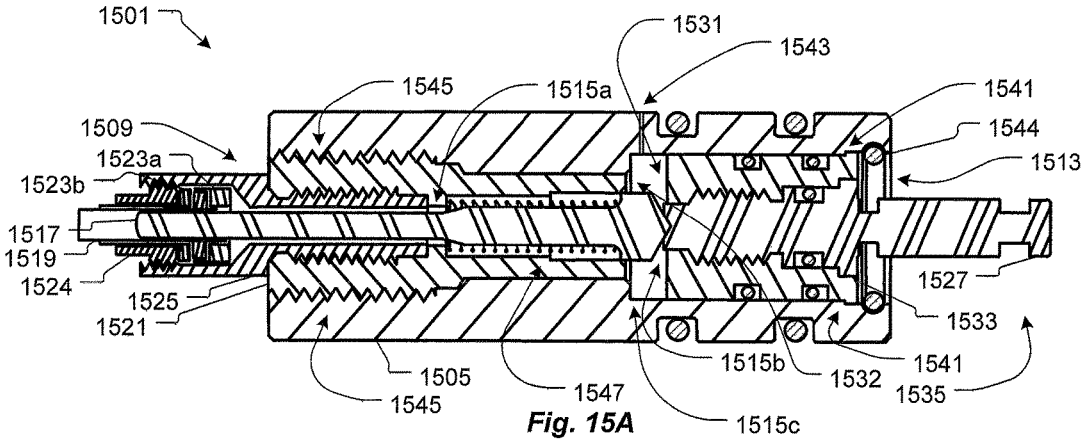
FIG. 15A is a cross section view of a high pressure switch with a sliding electrical connection in a first position illustrated according to the present application.
Figure 15B:
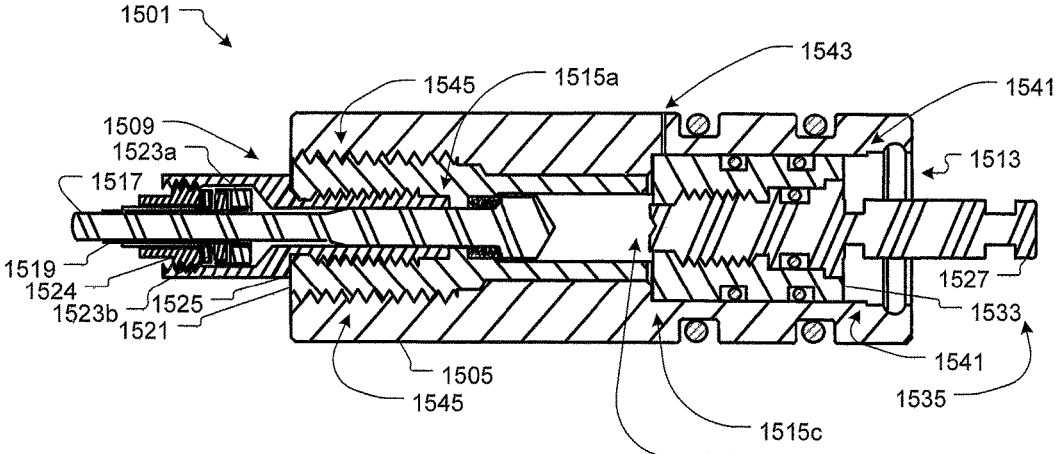
FIG. 15B is a cross section view of a high pressure switch with a sliding electrical connection in a second position illustrated according to the present application.
Figure 15C:
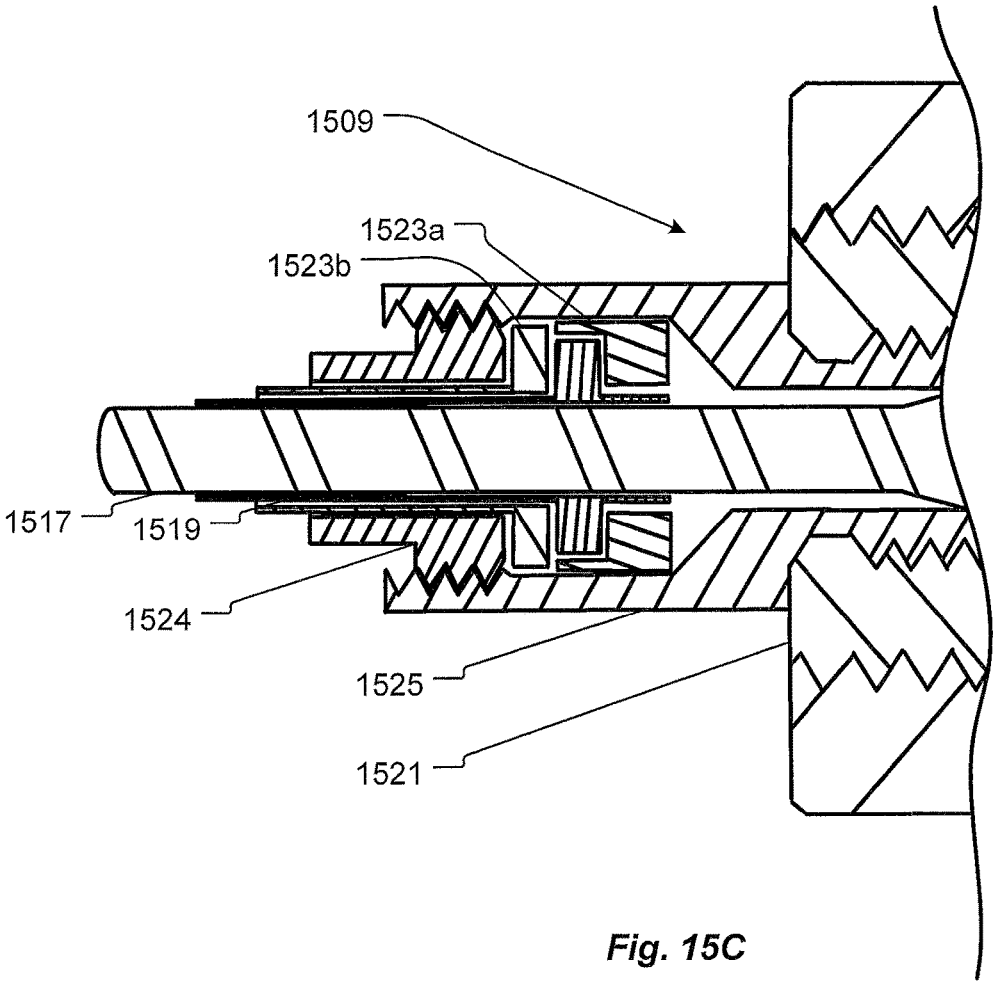
FIG. 15C is a magnified partial cross section view of a high pressure switch with a sliding electrical connection in a second position illustrated according to the present application.

Referring now to FIG. 15A in the drawings, a cross section view of a high pressure switch with an alternative sliding electrical connection in a first position illustrated according to the present application. Referring now also to FIG. 15B in the drawings, a cross section view of a high pressure switch with an alternative sliding electrical connection in a second position illustrated according to the present application. Switch 1501 is comprised of a body 1505, a firing pin assembly 1509, a piston assembly 1513, a first gap 1515*a*, a second gap 1515*b*, and a third gap 1515*c*. Body 1505 is tubular shaped with an opening through an entire length of the switch 1501. Firing pin assembly 1509 is comprised of a firing pin 1517, a biased conductive member 1519, a first firing pin insulator 1521, a second firing pin insulator 1523*a*, a third firing pin insulator 1523*b*, an end cap 1524, and a firing pin conductive member 1525. Piston assembly 1513 is comprised of a piston conductive member 1527 and a piston insulator 1533.

Switch 1501 is configured to provide a mechanical method of switching a conductive path from an explosive force. Piston assembly 1513 translates along a portion of the body as a result of a shockwave from an explosion. Piston assembly 1513 is configured to move only in response to high force exerted on a piston end 1535 of the switch 1501. As piston assembly 1513 translates it apply a force upon the firing pin 1517, as the piston assembly stops the firing pin continues to move a distance creating an air gap between the firing pin and the piston. Piston assembly 1513 moves from a first position to a second position and the firing pin 1517 moves from the first position to the second position. FIG. 15A illustrates the first position. In the first position the switch 1501 is non-conductive along the piston to firing pin conductive member 1525 path because a first gap 1515*a* is open and the firing pin 1517 is not in electrical contact with the firing pin conductive member 1525. First gap 1515*a* exists between the smallest diameter of the firing pin 1517 and an internal opening of the firing pin conductive member 1525. Second gap 1515*b* in the first position does not exist as the gap is between the conical tip of the firing pin 1517 and a conical end of the plunger assembly and in the first position the firing pin and the plunger assembly abut each other and are in electrical contact. Third gap 1515*c* results from an opening, having a length of three millimeters, between a firing pin end of the piston insulator 1531 and a piston end of the firing pin assembly 1532. In the second position the switch 1501 is conductive along a path from the firing pin conductive member 1525 to the firing pin 1517 because first gap 1515*a* is closed and second gap 1515*b* is open. In the second position the piston conductive member 1527 is not in contact with the firing pin 1517 and therefore no conductive path exists between them.

In order to increase the reliability of the switch 1501 over conventional systems, the body 1505 features a piston shoulder 1541, configured to increase the resistance between the piston assembly 1513 and the body, and an opening 1543. The piston shoulder 1541 is comprised of a decrease in a diameter of the opening through the body. A width of the piston shoulder is preferably between ten thousands of an inch and fifteen thousands of an inch with a ±tolerance of five thousands of an inch. Therefore the diameter of the opening decreases between twenty thousands of an inch and thirty thousands of an inch. The decrease in the opening from the piston end 1535 of the switch increases the amount of force required to translate the piston assembly 1513. A piston shoulder or break away having a width of twelve thousands of an inch typically requires approximately three hundred pounds of force to distort the piston insulator 1533 to allow the piston assembly 1513 to translate. Piston shoulder 1541 has a length of approximately thirty thousands of an inch with a ±tolerance of ten thousands of an inch.

Opening 1543 precludes residual pressure internal to the body. A diameter of opening 1543 is preferably twenty thousands of an inch. After use, opening 1543 releases any internal pressure between the piston and the firing pin. Opening 1543 connects the gap to the external surface of the body on the firing pin side of the externally mounted o-rings. The location between the o-rings and the firing pin end of the switch precludes fluid from migrating through the opening 1543. Other than the piston shoulder 1541, the piston assembly is free to move relative to the body as a major portion of the piston assembly has a diameter five thousands of an inch smaller than the piston assembly opening in the body with a t tolerance of two thousands of an inch. O-ring 1544 retains the piston insulator 1533 and thereby retains the piston assembly 1513 relative to the body 1505 without the need for a press fit between the body and the piston assembly.

An additional element to increase the reliability of the switch is a threaded interface 1545 between the firing pin assembly 1509 and the body 1505. The threaded interface 1545 provides increased strength between the body 1505 and the firing pin assembly 1509 to resist the force induced into the firing pin assembly from the piston assembly 1513 and firing pin 1517. Preferably a length of the threaded interface is longer than a depth of the firing pin conductive member 1525 in the first firing pin insulator 1521.

Stopping shoulder 1547 located in the first firing pin insulator 1521 slows the firing pin 1517 down and deforms. Stopping shoulder 1547 reduces the failure of the firing pin conductive member 1525 to stop the firing pin 1517. Conventional switches rely only on friction between the firing pin and the firing pin conductive member to slow and stop the firing pin. Stopping shoulder 1547 is configured to stop the firing pin in addition to the friction between the firing pin 1517 and the firing pin conductive member 1525. Stopping shoulder 1547 has a width of ten thousands of an inch, therefore the difference in diameters between regions of the firing pin insulator is approximate twenty thousands of an inch with a ±tolerance of five thousands of an inch. As shown in FIG. 15B the stopping shoulder 1547 has deformed as it slowed down the firing pin 1517.

Second firing pin insulator 1523*a* is comprised of a material, such as plastic, that prevents electrical connections between the firing pin conductor 1525 and the biased conductive member 1519. Third firing pin insulator 1523*b* is comprised of a material, such as plastic, that prevents electrical connections between the firing pin conductor 1525 and the biased conductive member 1519. Biased conductive member 1519 is comprised of a metallic tube having a plurality of springy finger like members in contact with the firing pin. The biased conductive member 1519 has an opening throughout the center of the member having an inner diameter smaller than the diameter of the firing pin near the finger like members. Biased conductive member 1519 is not threaded like biased conductive member 1101 because biased conductive member 1519 is retained between two separate insulators retaining a raised annular portion of the biased conductive member 1519. Therefore the finger like members remain in contact with the firing pin as the firing pin translates. The finger like members create a first sliding electrical connection between the biased conductive member and the firing pin. Once the switch is activated the firing pin is in electrical contact with the firing pin conductive member as it slides past to form a second electrical connection.

Switch 1501 provides an electrical connection between two electrical circuits. Wiring is hand wound around an exposed end of the piston conductive member 1527, the firing pin conductive member 1525, and to the biased conductive member 1519. Before the switch is activated there is an electrical circuit between the piston conductive member 1527 and to the biased conductive member 1519 and the rest of the string. Once the switch has been explosively activated, the electrical circuit between the piston conductive member 1527 and to the biased conductive member 1519 is opened. The actuation of the switch does close a circuit between the biased conductive member 1519 and the firing pin conductive member 1525.

Figure 16A:
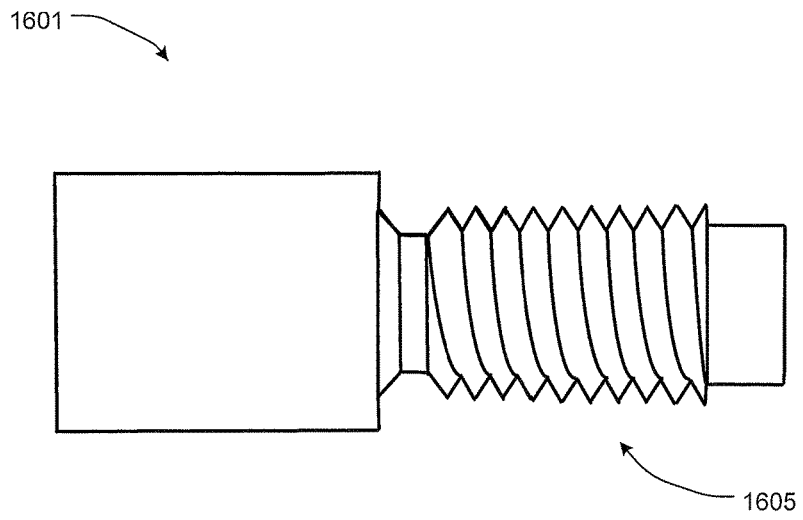
FIG. 16A is a side view of an alternative firing pin conductive member of a high pressure switch illustrated according to the present application.
Figure 16B:
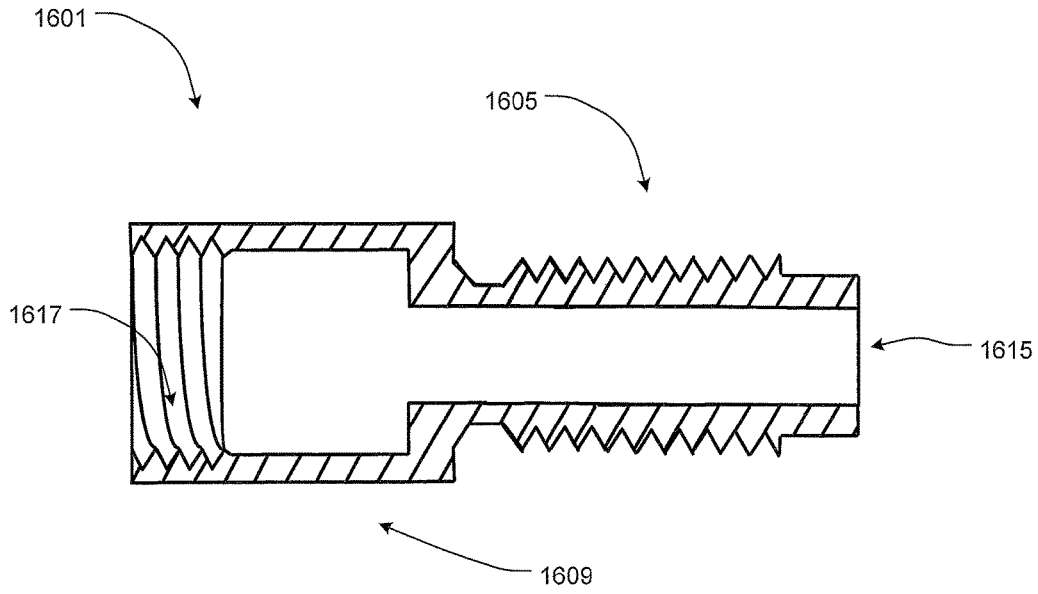
FIG. 16B is a cross section view of an alternative firing pin conductive member of a high pressure switch illustrated according to the present application.

Referring now also to FIG. 16A in the drawings, a side view of a conductive member illustrated according to the present application. Referring now also to FIG. 16B in the drawings, a cross section view of a conductive member illustrated according to the present application. Firing pin conductive member 1601 is fabricated from preferably brass and is conductive. Firing pin conductive member 1601 is tubular and has an exterior threaded portion 1605, an exterior portion 1609, and an opening 1615 that runs the length of the conductive member. Opening 1615 preferably has a first diameter sized to receive a portion of the firing pin and a second diameter of an internally threaded portion 1617 configured to receive an end cap outwardly facing threads. Exterior threaded portion 1605 of the firing pin conductive member 1601 is received by the firing pin insulator.

Figure 17A:
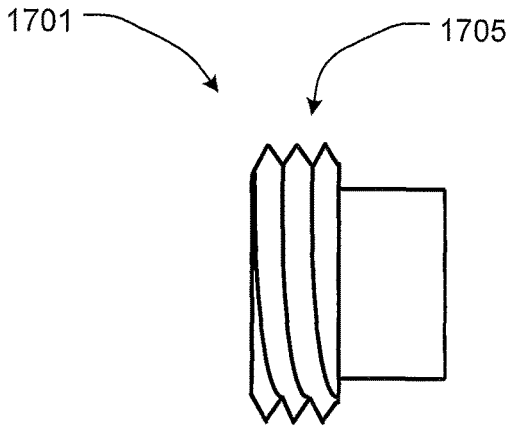
FIG. 17A is a side view of an end cap of a high pressure switch illustrated according to the present application.
Figure 17B:
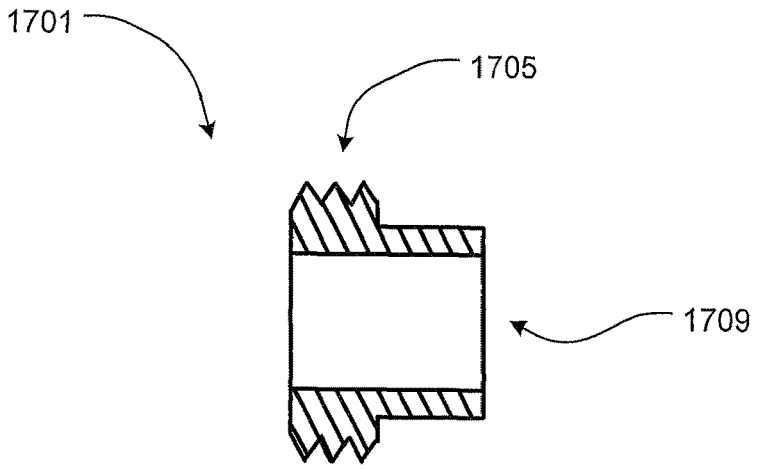
FIG. 17B is a cross section view of an end cap of a high pressure switch illustrated according to the present application.

Referring now also to FIG. 17A in the drawings, a side view of an end cap illustrated according to the present application. Referring now also to FIG. 17B in the drawings, a cross section view of an end cap illustrated according to the present application. End cap 1701 is fabricated from preferably brass and is conductive. End cap 1701 is tubular and has an exterior threaded portion 1705 and an opening 1709 that runs the length of the end cap. Opening 1709 preferably has a uniform diameter sized to receive the third firing pin insulator. Exterior threaded portion 1705 of the end cap is received by the internally threaded portion of the firing pin conductive member.

Figure 18A:
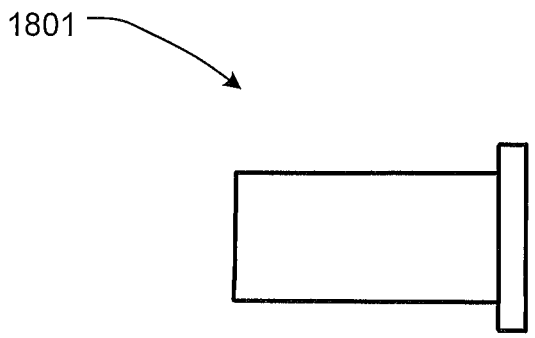
FIG. 18A is a side view of a second firing pin insulator of a high pressure switch illustrated according to the present application.
Figure 18B:
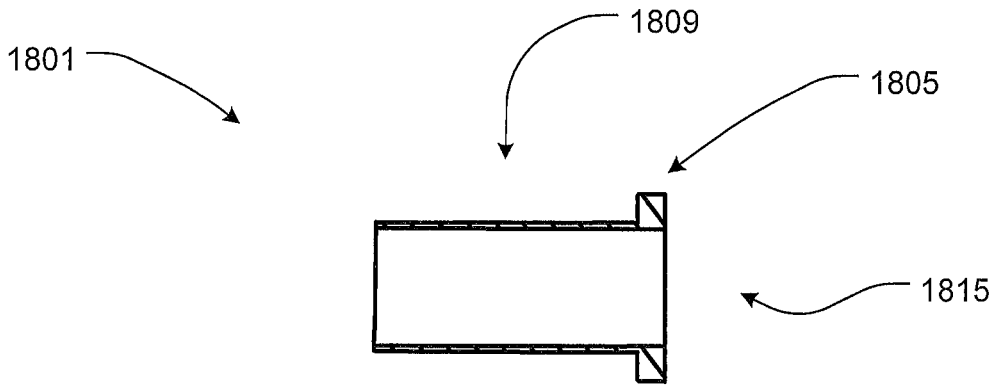
FIG. 18B is a cross section view of a second firing pin insulator of a high pressure switch illustrated according to the present application.

Referring now also to FIG. 18A in the drawings, a side view of a second firing pin insulator illustrated according to the present application. Referring now also to FIG. 18B in the drawings, a cross section view of a second firing pin insulator illustrated according to the present application. Second firing pin insulator 1801 is fabricated from preferably plastic and is non-conductive. Second firing pin insulator 1801 is tubular and has a lip 1805, a body 1809, and an opening 1815 that runs the length of the non-conductive member. Opening 1815 preferably has a uniform diameter and sized larger than thinnest portion of the firing pin. Lip 1805 is configured to be retained between the end cap and a lip of the biased conductive member. Second firing pin insulator prevents electrical connection between the biased conductive member and the end cap.

Figure 19A:
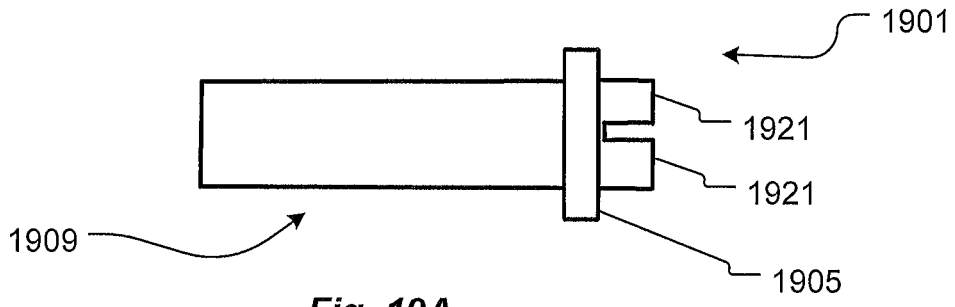
FIG. 19A is a side view of a biased conductive member of a high pressure switch illustrated according to the present application.
Figure 19B:
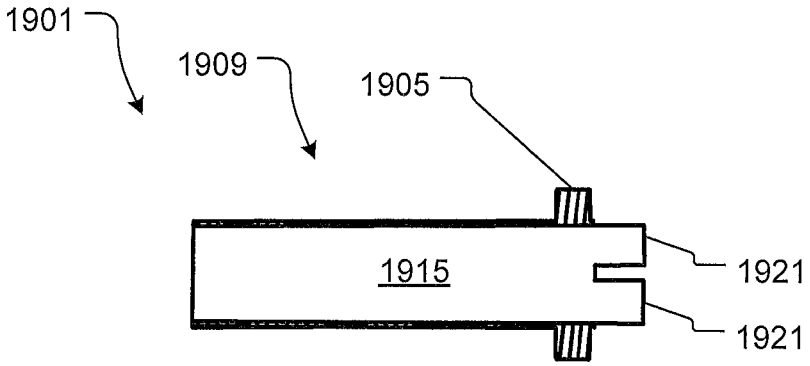
FIG. 19B is a cross section view of a biased conductive member of a high pressure switch illustrated according to the present application.
Figure 19C:
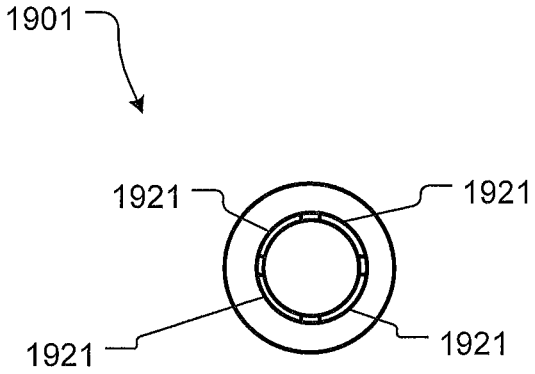
FIG. 19C is a end view of a biased conductive member of a high pressure switch illustrated according to the present application.

Referring now also to FIG. 19A in the drawings, a side view of a biased conductive member illustrated according to the present application. Referring now also to FIG. 19B in the drawings, a cross section view of a biased conductive member illustrated according to the present application. Referring now also to FIG. 19C in the drawings, an end view of a biased conductive member illustrated according to the present application. Biased conductive member 1901 is fabricated from preferably brass, is conductive and one-piece. Biased conductive member 1901 is tubular has a raised ring 1905, an exterior portion 1909, and an opening 1915 that runs the length of the biased conductive member. Opening 1915 preferably has a uniform diameter and sized to receive a portion of the firing pin near a plurality of spring like finger member 1921. The finger members are made by cutting slots into the tubular member and the inner diameter of the biased conductive member is smaller than a narrowest portion of the firing pin. Exterior portion 1909 extends outside the switch and is the end of an unfired switch, and is configured for the soldering of an electrical connection between the biased conductive member and the rest of the string. It should be apparent that an electrical connection can be created by crimping wiring to the exterior portion 1909 of the biased conductive member 1901 instead of, or in addition to soldering.

Figure 20A:
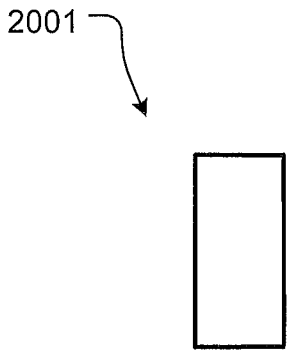
FIG. 20A is a side view of a third firing pin insulator of a high pressure switch illustrated according to the present application.
Figure 20B:
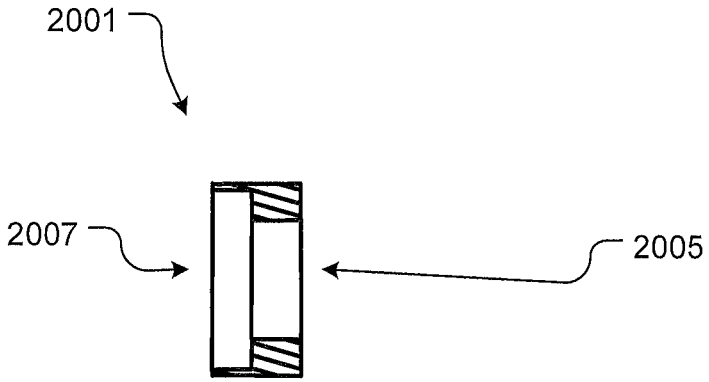
FIG. 20B is a cross section view of a third firing pin insulator of a high pressure switch illustrated according to the present application.

Referring now also to FIG. 20A in the drawings, a side view of a third firing pin Insulator illustrated according to the present application. Referring now also to FIG. 20B in the drawings, a cross section view of a third firing pin insulator illustrated according to the present application. Third firing pin insulator 2001 is fabricated from preferably plastic and is non-conductive. Third firing pin insulator 2001 is tubular and has a recess 2005 and an opening 2007 that runs the length of the non-conductive member. Opening 2007 preferably has a uniform diameter and sized larger than thinnest portion of the firing pin. Recess 2005 is configured to be retained between a ring of the biased conductive member and the firing pin conductive member. Second firing pin insulator prevents electrical connection between the biased conductive member and the firing pin conductive member.

A system is herein described that overcomes the limitations of the current high pressure switches for electrically coupling explosive charges. The elements described herein increase the reliability of the system and reduce failures. First, threading the interfaces between the various elements reduces the possibility that firing pin is ejected from the switch during use. Second, the shoulder reduces the possibility that firing pin Is ejected from the switch during use and prevents unintentional activation of the switch. Third, recessing the firing pin increases the mechanical strength of the electrical connection with the firing pin and the rest of the electrical circuit. Fourth, providing an electrical connection that translates It is apparent that an assembly and method with significant advantages has been described and illustrated. The particular embodiments disclosed above are illustrative only, as the embodiments may be modified and practiced in different but equivalent manners apparent to those skilled in the art having the benefit of the teachings herein. It Is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A high pressure switch for perforation of a well, comprising:
- a body;
- a piston assembly; and
- a firing pin assembly, having;
  - a firing pin;
  - a biased conductive member located around the firing pin;
  - a first electrical connection in sliding electrical connection to the firing pin;
  - a firing pin conductive member;
  - a end cap threadingly attached to the firing pin conductive member;
  - a first insulator located between the biased conductive member and the end cap; and
  - a second insulator located between the biased conductive member and the firing pin conductive member.

2. The high pressure switch according to claim 1, wherein the biased conductive member is compressed such that a portion of an inner diameter of the biased conductive member is smaller than a smallest diameter of the firing pin.

3. The high pressure switch according to claim 1, wherein the firing pin assembly is threadingly retained by the body.

4. The high pressure switch according to claim 1, the piston assembly comprising:
- a piston conductive member; and
- a piston insulator;
- wherein the piston conductive member is threadingly retained by the piston insulator.

5. The high pressure switch according to claim 4, the piston insulator comprising:
- a shoulder configured to break away.

6. The high pressure switch according to claim 4, wherein the piston insulator is only retained in the body by an o-ring.

7. The high pressure switch according to claim 5, wherein the shoulder maintains a gap between the piston assembly and the firing pin assembly.

8. The high pressure switch according to claim 7, the firing pin assembly further comprising:

a stopping shoulder configured to retain a head of the firing pin.

9. A high pressure switch for electrical control of perforation of a hydrocarbon well, comprising:

a body;

a piston assembly, having;

a piston insulator, having;

a break away shoulder; and a piston conductive member threadingly retained by the piston insulator;

a firing pin assembly, having:

a firing pin insulator threadingly retained by the body having;

a stopping shoulder;

a firing pin;

a firing pin conductive member threadingly retained by the firing pin insulator;

a biased conductive member in electrical contact with the firing pin;

an o-ring;

a end cap threadingly attached to the firing pin conductive member;

a first insulator located between the biased conductive member and the end cap; and a second insulator located between the biased conductive member and the firing pin conductive member;

wherein the piston assembly is retained between the o-ring and the body; and wherein the biased conductive member remains stationary as the firing pin translates.

10. The high pressure switch according to claim 9, further comprising:

a opening in the body configured to act as a vent between the piston assembly and an external surface of the body.

11. The high pressure switch according to claim 9, wherein the biased conductive member is compressed such that a portion of an inner diameter of the biased conductive member is smaller than a smallest diameter of the firing pin.

* * * * *